US006210563B1

(12) United States Patent
Tsao et al.

(10) Patent No.: US 6,210,563 B1
(45) Date of Patent: Apr. 3, 2001

(54) PROCESS FOR PRODUCING DIESEL FUEL WITH INCREASED CETANE NUMBER

(75) Inventors: Ying-Yen P. Tsao, Bryn Mawr, PA (US); Tracy J. Huang, Lawrenceville; Philip J. Angevine, Woodbury, both of NJ (US)

(73) Assignee: Mobil Oil Corporation, Fairfax, VA (US)

( * ) Notice: Subject to any disclaimer, the term of this patent is extended or adjusted under 35 U.S.C. 154(b) by 0 days.

(21) Appl. No.: 09/222,977

(22) Filed: Dec. 30, 1998

(51) Int. Cl.[7] ..... C10G 35/085

(52) U.S. Cl. ..... 208/138; 208/134; 208/135; 208/137; 208/111.01; 208/111.35; 208/15; 208/16; 208/143; 208/144; 208/145; 585/266; 585/269

(58) Field of Search ..... 208/134, 135, 208/137, 138, 111.01, 111.35, 15, 16, 143, 144, 145; 585/266, 269

(56) References Cited

U.S. PATENT DOCUMENTS

| | | | | |
|---|---|---|---|---|
| 4,494,961 | | 1/1985 | Venkat et al. | 44/57 |
| 4,610,779 | * | 9/1986 | Markley et al. | 208/212 |
| 4,676,885 | | 6/1987 | Bush | 208/49 |
| 4,676,887 | * | 6/1987 | Fischer et al. | 208/61 |
| 4,803,185 | | 2/1989 | Miller et al. | 502/65 |
| 4,820,402 | | 4/1989 | Partridge et al. | 208/111 |
| 4,840,930 | | 6/1989 | LaPierre et al. | 502/79 |
| 4,882,307 | | 11/1989 | Tsao | 502/66 |
| 4,889,616 | | 12/1989 | Miller et al. | 208/114 |
| 4,960,505 | * | 10/1990 | Minderhoud et al. | 208/143 |
| 5,037,531 | | 8/1991 | Bundens et al. | 208/120 |
| 5,041,401 | | 8/1991 | Schoennagel et al. | 502/61 |
| 5,139,647 | | 8/1992 | Miller | 208/100 |
| 5,147,526 | * | 9/1992 | Kukes et al. | 208/111 |
| 5,171,422 | | 12/1992 | Kirker et al. | 208/111 |
| 5,183,557 | | 2/1993 | Degnan, Jr. et al. | 208/111 |
| 5,284,985 | | 2/1994 | Girgis et al. | 585/310 |
| 5,290,744 | | 3/1994 | Degnan, Jr. et al. | 502/67 |
| 5,364,997 | | 11/1994 | Girgis et al. | 585/253 |
| 5,382,730 | | 1/1995 | Breckenridge et al. | 585/310 |
| 5,384,296 | | 1/1995 | Tsao | 502/66 |
| 5,391,291 | * | 2/1995 | Winquist et al. | 208/143 |
| 5,451,312 | * | 9/1995 | Apelian et al. | 208/143 |
| 5,463,155 | | 10/1995 | Galperin et al. | 585/310 |
| 5,520,799 | | 5/1996 | Brown et al. | 208/143 |
| 5,583,276 | | 12/1996 | Hellring et al. | 585/722 |
| 5,609,752 | * | 3/1997 | Del Rossi, et al. | 208/144 |
| 5,611,912 | * | 3/1997 | Han et al. | 208/58 |
| 5,763,731 | | 6/1998 | McVicker et al. | 585/737 |
| 5,831,139 | | 11/1998 | Schmidt et al. | 585/315 |
| 5,865,985 | * | 2/1999 | Desai et al. | 208/57 |

OTHER PUBLICATIONS

Zi, G., Yi, T and Yugin, Z., "Effect of Dealumination Defects on the Properties of Zeolite Y," *Applied Catalyst*, 56:83–94(1989.—No Month.

Thakur, D. and Weller, S.W., "On the Existence of Hydroxyl Nests in Acid–Extracted Mordenites," *Academic Press, Inc.*, 543–546(1972).—No Month.

Anderson, J.R., Measurement Techniques: Surface Area, Particle Size and Pore Structure, *Academic Press, London*, 289–394(1975).—No Month.

* cited by examiner

*Primary Examiner*—Walter D. Griffin
*Assistant Examiner*—Nadine Preisch
(74) *Attorney, Agent, or Firm*—Gerard J. Hughes

(57) ABSTRACT

A process is provided for selectively producing diesel fuel with increased cetane number from a hydrocarbon feedstock. The process includes contacting the feedstock with a catalyst which has a large pore crystalline molecular sieve material component having a faujasite structure and alpha acidity of less than 1, preferably about 0.3 or less. The catalyst also contains a dispersed Group VIII noble metal component which catalyzes the hydrogenation/hydrocracking of the aromatic and naphthenic species in the feedstock.

9 Claims, 6 Drawing Sheets

PROCESS FOR PRODUCING DIESEL FUEL WITH INCREASED CETANE NUMBER

BACKGROUND OF THE INVENTION

The present invention relates to a hydrocracking process. More particularly, the invention relates to a hydrocracking process which yields diesel fuels with increased cetane levels.

Due to upcoming global environmental and governmental mandates, petroleum refiners are seeking the most cost-effective means of improving the quality of their diesel fuel products. The new European Union (EU) diesel cetane number specification of 58 in the year 2005 will require existing processes to be upgraded or the development of new processes.

Aromatic saturation has been commonly utilized to upgrade the cetane level of diesel fuels. However, even with complete aromatic saturation, the cetane level of diesel fuels is only marginally improved; especially those fuels derived from thermal cracking processes such as light cycle oil and coker gas oil. This limited improvement in cetane levels is due to the fact that aromatic saturation can only make low cetane naphthenic species, not the high cetane components such as normal paraffins and iso-paraffins.

A process that increases diesel cetanes through selective ring-opening of naphthenic species, while avoiding cracking the beneficial diesel fuel range paraffins to naphtha and gaseous by-products is therefore desirable. Prior attempts to further increase product cetane levels through selective ring opening of the hydrogenated naphthenic intermediates have not been very successful for a number of reasons.

First, the conventional hydrocracking catalysts are not very selective and cannot be limited to opening naphthene rings, without concurrently cracking some of the paraffinic components. Thus, they frequently result in high diesel yield loss and high yield of gaseous by-product.

Secondly, commercial hydrocracking catalysts which rely on acidity as the active ring opening site will also catalyze increased branching of the resulting naphthenes and paraffins. This branching or isomerization results in cetane loss. Consequently, the more hydroisomerization a given catalyst exhibits, the more cetane loss the diesel products suffer. Typically, as a result of hydroisomerization activity, a cumulative loss of 18–20 cetane numbers is observed for each methyl branching increase.

Thirdly, regardless of the cracking mechanism, molecular weight reduction results in cetane loss when similar molecular structure types are preserved. Normally, a decrease of 3–4 cetane numbers per carbon loss is observed. Thus, endpoint cracking frequently results in cetane loss.

In light of the disadvantages of the conventional processes, there remains a need for a hydrocracking process that produces an increased cetane number without the corresponding diesel yield loss.

SUMMARY OF THE INVENTION

In accordance with the present invention, a hydrocracking process is provided which increases the cetane number in the diesel yield through the use of novel low acidic catalysts. The process minimizes diesel yield loss, the production of iso-paraffins, and gaseous by-product.

In the process, a feedstock is contacted under superatmospheric hydrogen conditions with a catalyst having a crystalline molecular sieve material component and a Group VIII noble metal component. The crystalline molecular sieve material component is a large pore faujasite structure having an alpha acidity of less than 1, preferably less than 0.3. Zeolite USY is the preferred crystalline molecular sieve material component.

The Group VIII noble metal component can be platinum, palladium, iridium, rhodium, or a combination thereof Platinum is preferred. The content of the Group VIII noble metal component can vary between about 0.01 and about 5% by weight of the catalyst.

The Group VIII noble metal component is located within the catalyst in dispersed clusters. In the preferred embodiment, the particle size of the Group VIII metal on the catalyst is less than about 10 Å. Dispersion of the metal can also be measured by hydrogen chemisorption technique in terms of the H/metal ratio. In the preferred embodiment, when platinum is used as the Group VIII noble metal component, the H/Pt ratio is between about 1I.1 and 1.5.

The hydrocracking conditions can be a pressure from about 400 to about 1000 psi $H_2$, a temperature from about 550° F. to about 700° F., a space velocity of about 0.1 to about 10 LHSV, and a hydrogen circulation rate of about 1400 to about 5600 SCF/bbl. It is preferred that the catalyst utilized in the process of the invention be formed by self and/or silica binding.

BRIEF DESCRIPTION OF THE DRAWINGS

FIG. 1 is a graph showing conversion vs. reactor temperature.

FIG. 2 is a graph showing product yield vs. cracking severity.

FIG. 3 is a graph showing $T_{90}$ of 400° F.$^+$ diesel products.

FIG. 4 is a graph showing $T_{90}$ reduction and reaction temperature v. $H_2$ consumption.

FIG. 5 is a graph showing 400° F.$^+$ product cetane vs. cracking severity.

FIG. 6 is a graph showing $T_{90}$ reduction and $H_2$ consumption vs. gas make.

DETAILED DESCRIPTION OF INVENTION

Figure 1:
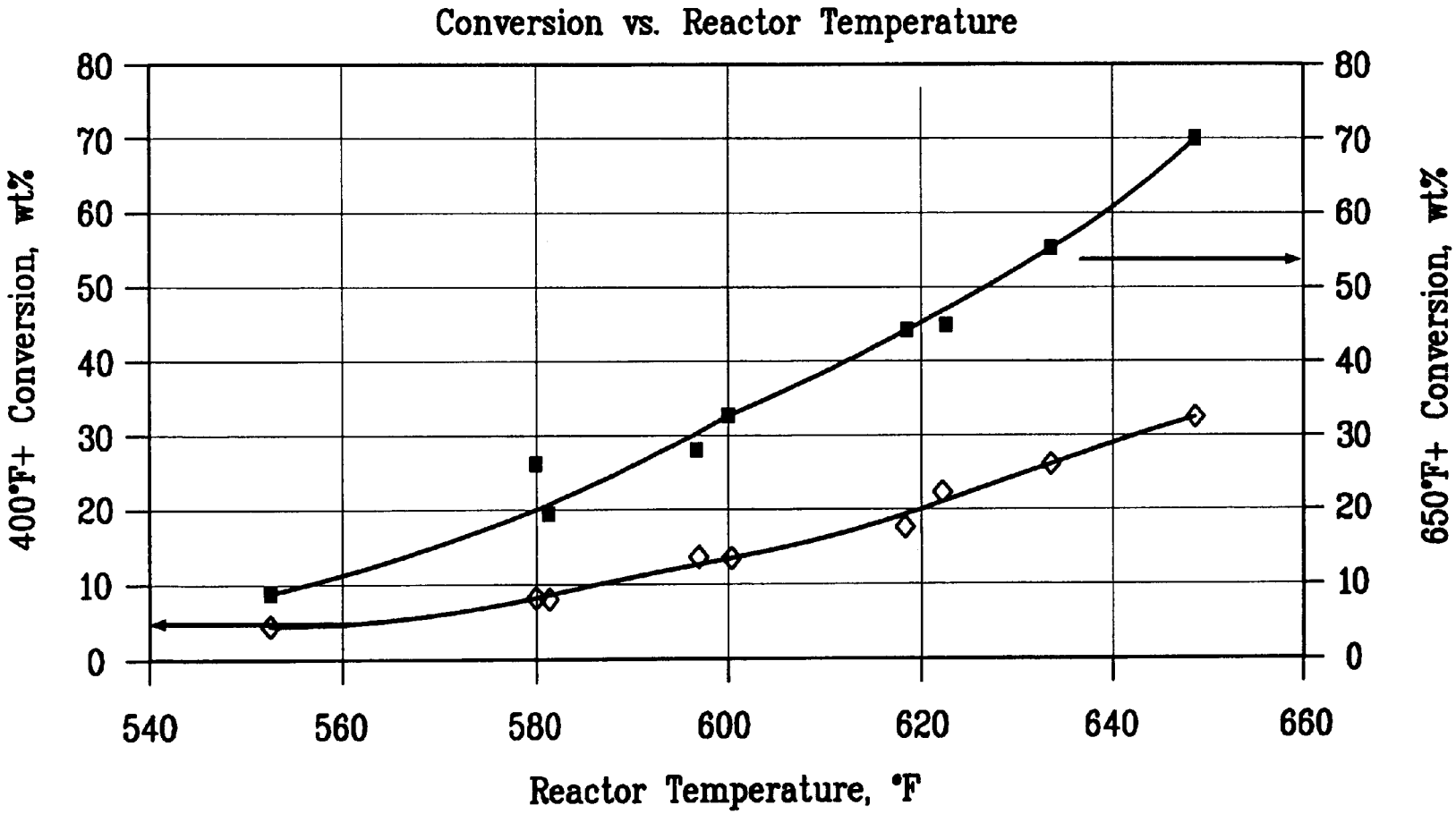
FIGS. 1–6 are graphs showing data obtained for a process within the scope of the invention.

Through the use of novel low acidic catalysts, the process of the invention is selective for ring opening of naphthenic species with minimal cracking of paraffins. Consequently, the process of the invention provides enhanced cetane levels while retaining a high diesel fuel yield.

The diesel fuel product will have a boiling point range of about 350° F. (about 175° C.) to about 650° F. (about 345° C.). The process of the invention can be used to either upgrade a feedstock within the diesel fuel boiling point range to a high cetane diesel fuel or can be used to reduce higher boiling point feeds to a high cetane diesel fuel. A high cetane diesel fuel is defined as diesel fuel having a cetane number of at least 50.

Cetane number is calculated by using either the standard ASTM engine test or NMR analysis. Although cetane number and cetane index have both been used in the past as measures of the ignition quality of diesel fuels, they should not be used interchangeably. Cetane index can frequently overestimate the quality of diesel fuel streams derived from hydroprocessing. Thus, cetane number is used herein.

The properties of the feedstock will vary according to whether the feedstock is being hydroprocessed to form a high cetane diesel fuel, or whether low cetane diesel fuel is being upgraded to high cetane diesel fuel.

The feedstocks to be hydroprocessed to a diesel fuel product can generally be described as high boiling point feeds of petroleum origin. In general, the feeds will have a boiling point range of about 350 to about 750° F. (about 175 to about 400° C.), preferably about 400 to about 700° F. (about 205 to about 370° C.). Generally, the preferred feedstocks are non-thermocracked streams, such as gasoils distilled from various petroleum sources. Catalytic cracking cycle oils, including light cycle oil (LCO) and heavy cycle oil (HCO), clarified slurry oil (CSO) and other catalytically cracked products are potential sources of feeds for the present process. If used, it is preferred that these cycle oils make up a minor component of the feed. Cycle oils from catalytic cracking processes typically have a boiling range of about 400° to 750OF (about 205° to 400° C.), although light cycle oils may have a lower end point, e.g. 600 or 650° F. (about 315° C. or 345° C.). Because of the high content of aromatics and poisons such as nitrogen and sulfur found in such cycle oils, they require more severe process conditions, thereby causing a loss of distillate product. Lighter feeds may also be used, e.g. about 250° F. to about 400° F. (about 120 to about 205° C.). However, the use of lighter feeds will result in the production of lighter distillate products, such as kerosene.

The feed to the process is rich in naphthenic species, such as found in a hydrocrackate product. The naphthenic content of the feeds used in the present process generally will be at least 5 weight percent, usually at least 20 weight percent, and in many cases at least 50 weight percent. The balance will be divided among n-paraffins and aromatics according to the origin of the feed and its previous processing. The feedstock should not contain more than 50 weight percent of aromatic species, preferably less than 40 weight percent.

The process operates with a low sulfur feed generally having less than about 600 ppm sulfur and less than about 50 ppm nitrogen. Hydrotreated or hydrocracked feeds are preferred. Hydrotreating can saturate aromatics to naphthenes without substantial boiling range conversion and can remove poisons from the feed. Hydrocracking can also produce distillate streams rich in naphthenic species, as well as remove poisons from the feed.

Hydrotreating or hydrocracking the feedstock will usually improve catalyst performance and permit lower temperatures, higher space velocities, lower pressures, or combinations of these conditions, to be employed. Conventional hydrotreating or hydrocracking process conditions and catalysts known in the art can be employed.

A low cetane diesel fuel can be upgraded by the process of the invention. Such a feedstock will have a boiling point range within the diesel fuel range of about 400 to about 750° F. (about 205 to about 400° C.).

The feeds will generally be made up of naphthenic species and high molecular weight aromatics, as well as long chain paraffins. The fused ring aromatics and naphthenes are selectively hydrogenated and then hydrocracked during the process of the invention by the highly dispersed metal function on the catalyst due to the affinity of the catalyst for aromatic and naphthenic structures. The unique selectivity of the catalyst minimizes secondary hydrocracking and hydroisomerization of paraffins. The present process is, therefore, notable for its ability to upgrade cetane numbers, while minimizing cracking of the beneficial distillate range paraffins to naphtha and gaseous by-products.

The catalysts used in the process are described in co-pending application Ser. No. 09/222,978 filed concurrently herewith. The catalysts consist of a large pore crystalline molecular sieve component with a faujasite structure and an alpha acidity of less than 1, preferably 0.3 or less. The catalysts also contain a noble metal component. The noble metal component is selected from the noble metals within Group VIII of the Periodic Table.

Unlike most hydrocracking processes, catalyst acidity is not relied upon to drive the process of the invention. The process of the invention is driven by the Group VIII noble metal component which acts as a hydrogenation/hydrocracking component. The crystalline molecular sieve material acts as a host for the Group VIII noble metal. The ultra-low acidity permits the hydrocracking of the naphthenes without secondary cracking and hydroisomerization of paraffins. Therefore, the lower the acidity value, the higher the cetane levels and the diesel fuel yield. Also, the crystalline sieve material helps create the reactant selectivity of the hydrocracking process due to its preference for adsorbing aromatic hydrocarbon and naphthenic structures as opposed to paraffins. This preference of the catalyst for ringed structures allows the paraffins to pass through with minimal hydrocracking and hydroisomerization, thereby retaining a high cetane level.

The feedstock is passed over the catalyst under superatmospheric hydrogen conditions. The space velocity of the feed is usually in the range of about 0.1 to about 10 LHSV, preferably about 0.3 to about 3.0 LHSV. The hydrogen circulation rate will vary depending on the paraffinic nature of the feed. A feedstock containing more paraffins and fewer ringed structures will consume less hydrogen. Generally, the hydrogen circulation rate can be from about 1400 to about 5600 SCF/bbl (250 to 1000 $n.1.1^{-1}$), more preferably from about 1685 to about 4500 SCF/bbl (300 to 800 $n.1.1^{-1}$). Pressure ranges will vary from about 400 to about 1000 psi, preferably about 600 to about 800 psi. Reaction temperatures will range from about 550 to about 700° F. (about 288 to about 370° C.) depending on the feedstock. Heavier feeds or feeds with higher amounts of nitrogen or sulfur will require higher temperatures. At temperatures above 700° F., significant diesel yield loss will occur.

Constraint Index (CI) is a convenient measure of the extent to which a crystalline sieve material allows molecules of varying sizes access to its internal structure. Materials which provide highly restricted access to and egress from its internal structure have a high value for the Constraint Index and small pore size, e.g. less than 5 angstroms. On the other hand, materials which provide relatively free access to the internal porous crystalline sieve structure have a low value for the Constraint Index, and usually pores of large size, e.g. greater than 7 angstroms. The method by which Constraint Index is determined is described fully in U.S. Pat. No. 4,016,218, incorporated herein by reference.

The Constraint Index (Cl) is calculated as follows.

$$\text{Constraint Index} = \frac{\log_{10}(\text{fraction of n-hexane remaining})}{\log_{10}(\text{fraction of 3-methylpentane remaining})} \quad (1)$$

Large pore crystalline sieve materials are typically defined as having a Constraint Index of 2 or less. Crystalline sieve materials having a Constraint Index of 2–12 are generally regarded to be medium size zeolites.

The catalysts utilized in the process of the invention contain a large pore crystalline molecular sieve material component with a Constraint Index less than 2. Such materials are well known to the art and have a pore size sufficiently large to admit the vast majority of components normally found in a feedstock. The materials generally have a pore size greater than 7 Angstroms and are represented by zeolites having a structure of, e.g., Zeolite beta, Zeolite Y, Ultrastable Y (USY), Dealuminized Y (DEALY), Mordenite, ZSM-3, ZSM-4, ZSM-18 and ZSM-20.

The large pore crystalline sieve materials useful for the process of the invention are of the faujasite structure. Within the ranges specified above, crystalline sieve materials useful for the process of the invention can be zeolite Y or zeolite USY. Zeolite USY is preferred.

The above-described Constraint Index provides a definition of those crystalline sieve materials which are particularly useful in the present process. The very nature of this parameter and the recited technique by which it is determined, however, allow the possibility that a given zeolite can be tested under somewhat different conditions and thereby exhibit different Constraint Indices. This explains the range of Constraint Indices for some materials. Accordingly, it is understood to those skilled in the art that the CI, as utilized herein, while affording a highly useful means for characterizing the zeolites of interest, is an approximate parameter. However, in all instances, at a temperature within the above-specified range of 290° C. to about 538° C., the CI will have a value for any given crystalline molecular sieve material of particular interest herein of 2 or less.

It is sometimes possible to judge from a known crystalline structure whether a sufficient pore size exists. Pore windows are formed by rings of silicon and aluminum atoms. 12-membered rings are preferred in the catalyst of the invention in order to be sufficiently large to admit the components normally found in a feedstock. Such a pore size is also sufficiently large to allow paraffinic materials to pass through.

The crystalline molecular sieve material utilized in the hydrocracking catalyst has a hydrocarbon sorption capacity for n-hexane of at least about 5 percent. The hydrocarbon sorption capacity of a zeolite is determined by measuring its sorption at 25° C. and at 40 mm Hg (5333 Pa) hydrocarbon pressure in an inert carrier such as helium. The sorption test is conveniently carried out in a thermogravimetric analysis (TGA) with helium as a carrier gas flowing over the zeolite at 25° C. The hydrocarbon of interest, e.g., n-hexane, is introduced into the gas stream adjusted to 40 mm Hg hydrocarbon pressure and the hydrocarbon uptake, measured as an increase in zeolite weight, is recorded. The sorption capacity may then be calculated as a percentage in accordance with the relationship:

$$\text{Hydrocarbon Sorption Capacity (\%)} = \frac{\text{Wt. of Hydrocarbon Sorbed}}{\text{Wt. of zeolite}} \times 100 \quad (2)$$

The catalyst used in the process of the invention contains a Group VIII noble metal component. This metal component acts to catalyze both hydrogenation and hydrocracking of the aromatic and naphthenic species within the feedstock. Suitable noble metal components include platinum, palladium, iridium and rhodium, or a combination thereof Platinum is preferred. The hydrocracking process is driven by the affinity of the aromatic and naphthenic hydrocarbon molecules to the Group VIII noble metal component supported on the inside of the highly siliceous faujasite crystalline sieve material.

The amount of the Group VIII noble metal component can range from about 0.01 to about 5% by weight and is normally from about 0.1 to about 3% by weight, preferably about 0.3 to about 2 wt %. The precise amount will, of course, vary with the nature of the component. Less of the highly active noble metals, particularly platinum, is required than of less active metals. Because the hydrocracking reaction is metal catalyzed, it is preferred that a larger volume of the metal be incorporated into the catalyst.

Applicants have discovered that highly dispersed Group VIII noble metal particles acting as the hydrogenation/hydrocracking component reside on severely dealuminated crystalline molecular sieve material. The dispersion of the noble metal, such as Pt (platinum), can be measured by the cluster size of the noble metal component. The cluster of noble metal particles within the catalyst should be less than 10 Å. For platinum, a cluster size of about 10 Å would be about 30–40 atoms. This smaller particle size and greater dispersion provides a greater surface area for the hydrocarbon to contact the hydrogenating/hydrocracking Group VIII noble metal component.

The dispersion of the noble metal can also be measured by the hydrogen chemisorption technique. This technique is well known in the art and is described in J. R. Anderson, Structure of Metallic Catalysts, Academic Press, London, pp. 289–394 (1975), which is incorporated herein by reference. In the hydrogen chemisorption technique, the amount of dispersion of the noble metal, such as Pt (platinum), is expressed in terms of the H/Pt ratio. An increase in the amount of hydrogen absorbed by a platinum containing catalyst will correspond to an increase in the H/Pt ratio. A higher H/Pt ratio corresponds to a higher platinum dispersion. Typically, an H/Pt value of greater than 1 indicates the average platinum particle size of a given catalyst is less than 1 nm. For example, an H/Pt value of 1.1 indicates the platinum particles within the catalyst form cluster sizes of less than about 10 Å. In the process of the invention, the H/Pt ratio can be greater than about 0.8, preferably between about 1.1 and 1.5. The H/noble metal ratio will vary based upon the hydrogen chemisorption stoichiometry. For example, if rhodium is used as the Group VIII noble metal component, the H/Rh ratio will be almost twice as high as the H/Pt ratio, i.e. greater than about 1.6, preferably between about 2.2 and 3.0. Regardless of which Group VIII noble metal is used, the noble metal cluster particle size should be less than about 10 Å.

The acidity of the catalyst can be measured by its Alpha Value, also called alpha acidity. The catalyst utilized in the process of the invention has an alpha acidity of less than about 1, preferably about 0.3 or less. The Alpha Value is an approximate indication of the catalytic cracking activity of the catalyst compared to a standard catalyst and it gives the relative rate constant (rate of normal hexane conversion per volume of catalyst per unit time). It is based on the activity of the highly active silicaalumina cracking catalyst which has an Alpha of 1 (Rate Constant=0.016 $sec^{-1}$). The test for alpha acidity is described in U.S. Pat. No. 3,354,078; in the Journal of Catalysis, 4, 527 (1965); 6, 278 (1966); 61, 395 (1980), each incorporated by reference as to that description. The experimental conditions of the test used therein include a constant temperature of 538° C. and a variable flow rate as described in the Journal of Catalysis, 61, 395 (1980).

Alpha acidity provides a measure of framework alumina. The reduction of alpha indicates that a portion of the framework aluminum is being lost. It should be understood that the silica to alumina ratio referred to in this specification is the structural or framework ratio, that is, the ratio of the $SiO_4$ to the $Al_2O_4$ tetrahedra which, together, constitute the structure of the crystalline sieve material. This ratio can vary according to the analytical procedure used for its determination. For example, a gross chemical analysis may include aluminum which is present in the form of cations associated with the acidic sites on the zeolite, thereby giving a low silica:alumina ratio. Similarly, if the ratio is determined by thermogravimetric analysis (TGA) of ammonia desorption, a low ammonia titration may be obtained if cationic aluminum prevents exchange of the ammonium ions onto the acidic sites. These disparities are particularly troublesome when certain dealuminization treatments are employed which result in the presence of ionic aluminum free of the zeolite structure. Therefore, the alpha acidity should be determined in hydrogen form.

A number of different methods are known for increasing the structural silica:alumina ratios of various zeolites. Many of these methods rely upon the removal of aluminum from the structural framework of the zeolite employing suitable chemical agents. Specific methods for preparing dealuminized zeolites are described in the following to which reference may be made for specific details: "Catalysis by Zeolites" (International Symposium on Zeolites, Lyon, Sep. 9–11, 1980), Elsevier Scientific Publishing Co., Amsterdam, 1980 (dealuminization of zeolite Y with silicon tetrachloride); U.S. Pat. No. 3,442,795 and U.K. Pat. No. 1,058,188 (hydrolysis and removal of aluminum by chelation); U.K. Pat. No. 1,061,847 (acid extraction of aluminum); U.S. Pat. No 3,493,519 (aluminum removal by steaming and chelation); U.S. Pat. No. 3,591,488 (aluminum removal by steaming); U.S. Pat. No. 4,273,753 (dealuminization by silicon halide and oxyhalides); U.S. Pat. No. 3,691,099 (aluminum extraction with acid); U.S. Pat. No. 4,093,560 (dealuminization by treatment with salts); U.S. Pat. No. 3,937,791 (aluminum removal with Cr(III) solutions); U.S. Pat. No. 3,506,400 (steaming followed by chelation); U.S. Pat. No. 3,640,681 (extraction of aluminum with acetylacetonate followed by dehydroxylation); U.S. Pat. No. 3,836,561 (removal of aluminum with acid); German Offenleg. No. 2,510,740 (treatment of zeolite with chlorine or chlorine-containing gases at high temperatures), Dutch Pat. No. 7,604,264 (acid extraction), Japanese Pat. No. 53/101,003 (treatment with EDTA or other materials to remove aluminum) and J. Catalysis, 54, 295 (1978) (hydrothermal treatment followed by acid extraction).

The preferred dealuminization method for preparing the crystalline molecular sieve material component in the process of the invention is steaming dealuminization, due to its convenience and low cost. More specifically, the preferred method is through steaming an already low acidic USY zeolite (e.g., alpha acidity of about 10 or less) to the level required by the process, i.e. an alpha acidity of less than 1.

Briefly, this method includes contacting the USY zeolite with steam at an elevated temperature of about 550° to about 815° C. for a period of time, e.g about 0.5 to about 24 hours sufficient for structural alumina to be displaced, thereby lowering the alpha acidity to the desired level of less than 1, preferably 0.3 or less. The alkaline cation exchange method is not preferred because it could introduce residual protons upon $H_2$ reduction during hydroprocessing, which may contribute unwanted acidity to the catalyst and also reduce the noble metal catalyzed hydrocracking activity.

The Group VIII metal component can be incorporated by any means known in the art. However, it should be noted that a noble metal component would not be incorporated into such a dealuminated crystalline sieve material under conventional exchange conditions because very few exchange sites exist for the noble metal cationic precursors.

The preferred methods of incorporating the Group VIII noble metal component onto the interior of the crystalline sieve material component are impregnation or cation exchange. The metal can be incorporated in the form of a cationic or neutral complex; $Pt(NH_3)_4^{2+}$ and cationic complexes of this type will be found convenient for exchanging metals onto the crystalline molecular sieve component. Anionic complexes are not preferred.

The steaming dealuminization process described above creates defect sites, also called hydroxyl nests, where the structural alumina has been removed. The formation of hydroxyl nests are described in Gao, Z. et. al., "Effect of Dealumination Defects on the Properties of Zeolite Y", J. Applied Catalysis, 56:1 pp. 83–94 (1989); Thakur, D., et. al., "Existence of Hydroxyl Nests in Acid-Extracted Mordenites," J. Catal., 24:1 pp. 543–6 (1972), which are incorporated herein by reference as to those descriptions. Hydroxyl nests can also be created by other dealumination processes listed above, such as acid leaching (see, Thakur et. al.), or can be created during synthesis of the crystalline molecular sieve material component.

In the preferred method of preparing the catalyst utilized in the process of the invention, the Group VIII noble metal component is introduced onto the interior sites of the crystalline molecular sieve material component via impregnation or cation exchange with the hydroxyl nest sites in a basic solution, preferably pH of from about 7.5 to 10, more preferably pH 8–9. The solution can be inorganic, such a $H_2O$, or organic such as alcohol. In this basic solution, the hydrogen on the hydroxyl nest sites can be replaced with the Group VIII noble metal containing cations, such as at $Pt(NH_3)_4^{2+}$.

After the Group VIII noble metal component is incorporated into the interior sites of the crystalline molecular sieve material, the aqueous solution is removed by drying at about 130–140° C. for several hours. The catalyst is then dry air calcined for several hours, preferably 3–4 hours, at a temperature of about 350° C.

To be useful in a reactor, the catalyst will need to be formed either into an extrudate, beads, pellets, or the like. To form the catalyst, an inert support can be used that will not induce acidity in the catalyst, such as self- and/or silica binding of the catalyst. A binder that is not inert, such as alumina, should not be used since aluminum could migrate from the binder and become re-inserted into the crystalline sieve material. This re-insertion can lead to creation of the undesirable acidity sites during the post steaming treatment.

The preferred low acidic hydrocracking catalyst is a dealuminated Pt/USY catalyst.

The following examples are provided to assist in a further understanding of the invention. The particular materials and conditions employed are intended to be further illustrative of the invention and are not limiting upon the reasonable scope thereof

EXAMPLE 1

This example illustrates the preparation of a hydrocracking catalyst possessing an alpha acidity below the minimum required by the process of this invention.

A commercial TOSOH 390 USY (alpha acidity of about 5) was steamed at 1025° F. for 16 hours. X-ray diffraction showed an excellent crystallinity retention of the steamed sample. n-Hexane, cyclo-hexane, and water sorption capacity measurements revealed a highly hydrophobic nature of the resultant siliceous large pore zeolite. The properties of the severely dealuminated USY are summarized in Table 1.

TABLE 1

Properties of Dealuminated USY

| PROPERTY | VALUE |
|---|---|
| Zeolite Unit Cell Size | 24.23Å |
| Na | 115 ppm |
| n-Hexane Sorption Capacity | 19.4% |
| cyclo-Hexane Sorption Capacity | 21.4% |
| Water Sorption Capacity | 3.1% |
| Zeolite Acidity, α | 0.3 |

0.6 wt % of Pt was introduced onto the USY zeolite by cation exchange technique, using $Pt(NH_3)_4(OH)_2$ as the precursor. During the exchange in a pH 8.5–9.0 aqueous solution, $Pt(NE_3)_4^{+2}$cation replaced $H^+$ associated with the zeolitic silanol groups and hydroxyl nests. Afterwards, excess water rinse was applied to the Pt exchanged zeolite material to demonstrate the extra high $Pt(NH_3)_4^{+2}$ cation exchange capacity of this highly siliceous USY. The water was then removed at 130° C. for 4 hours. Upon dry air calcination at 350° C. for 4 hours, the resulting catalyst had an H/Pt ratio of 1.12, determined by standard hydrogen chemisorption procedure. The chemisorption result indicated that the dealuminated USY zeolite supported highly dispersed Pt particles (i.e. <10 Å). The properties of the resulting hydrocracking catalysts are set forth in Table 2 below.

TABLE 2

Hydrocracking Catalyst Properties

| PROPERTY | VALUE |
|---|---|
| H/Pt Ratio | 1.12 |
| Pt Content | 0.60% |

EXAMPLE 2

This example illustrates the process for selectively upgrading hydrocracker recycle splitter bottoms to obtain a product having an increased cetane content. The properties of the hydrocracker recycle splitter bottoms are set forth in Table 3.

TABLE 3

Properties of Feedstock

| PROPERTY | VALUE |
|---|---|
| API Gravity @ 60° F. | 39.3 |
| Sulfur, ppm | 1.5 |
| Nitrogen, ppm | <0.5 |
| Aniline Point, ° C. | 89.6 |
| Aromatics, wt % | 12.7 |
| Refractive Index | 1.43776 |
| Pour Point, ° C. | 9 |
| Cloud Point, ° C. | 24 |
| Simdis, ° F. (D2887) | |
| IBP | 368 |
| 5% | 414 |
| 10% | 440 |
| 30% | 528 |
| 50% | 587 |
| 70% | 649 |
| 90% | 736 |

TABLE 3-continued

Properties of Feedstock

| PROPERTY | VALUE |
|---|---|
| 95% | 776 |
| EP | 888 |

The reactor was loaded with catalyst and vycor chips in a 1:1 ratio. The catalyst was purged with a 10:1 volume ratio of $N_2$ to catalyst per minute for 2 hrs at 177° C. The catalyst was reduced under 4.4:1 volume ratio of $H_2$ to catalyst per minute at 260° C. and 600 psi for 2 hrs. The feedstock was then introduced.

The reaction was performed at 600 psig, 4400 SCF/bbl $H_2$ circulation rate and 0.4 LHSV (0.9 WHSV). Reaction temperatures ranged from 550 to 650° F.

Figure 2:
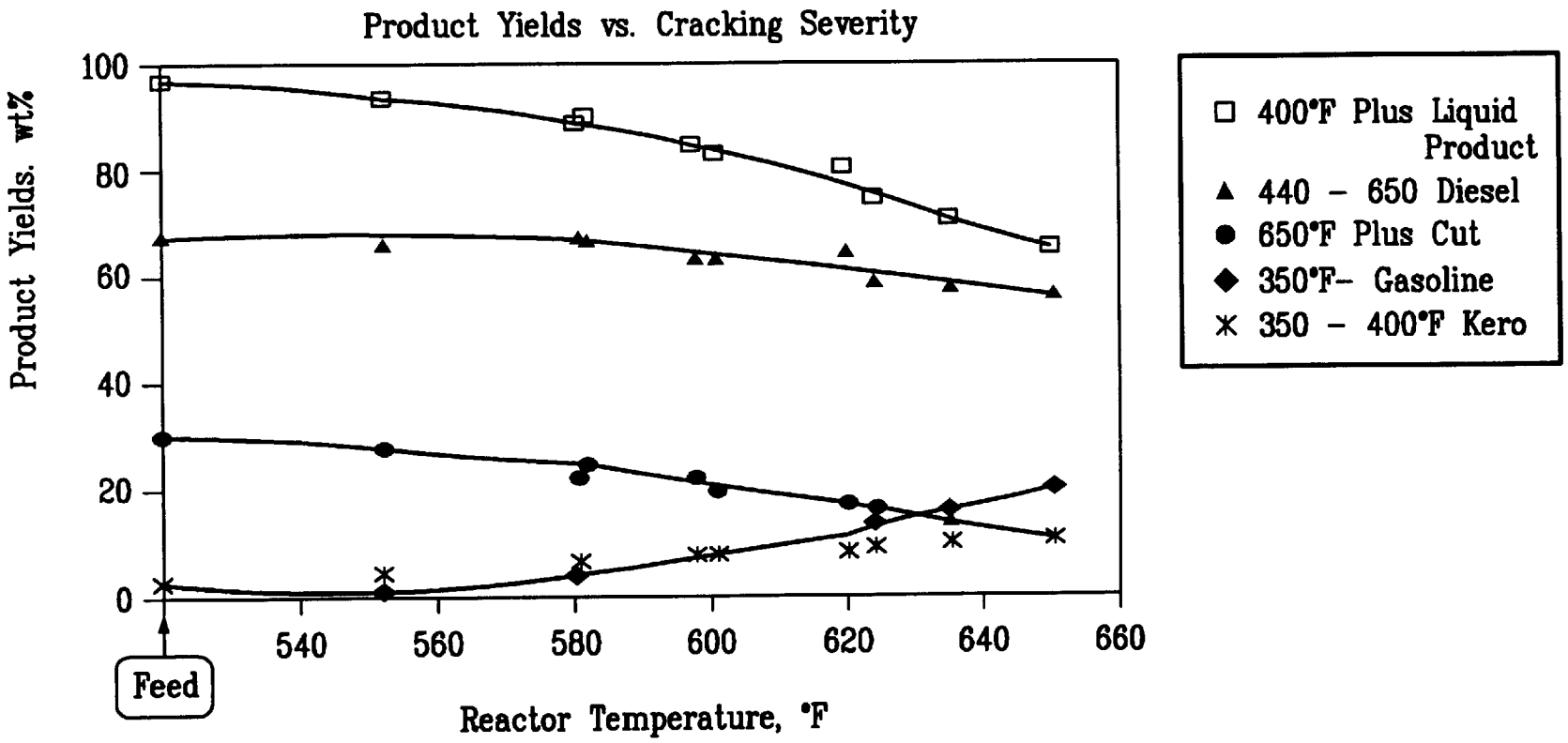

FIG. 1 demonstrates the selectivity of the catalyst in cracking the 650° $F^+$ heavy ends as opposed to the 400° $F.^+$ diesel front ends. For example, at 649° F., the catalyst converts 69 vs. 32% of 650° $F.^+$, and 400° $F.^+$, respectively. FIG. 2 shows the 400–650° F. diesel yields vs. cracking severity. At temperatures where extensive heavy-end cracking occurs (i.e. greater than 650° F.), the 400–650° F. diesel yields range from 56–63% in a descending order of reaction severity compared to a yield of 67% with the unconverted feed. The portion of 650° $F.^+$ bottoms contracts from 30% as existing in the feed to less than 9% at the highest severity tested, 649° F. Thus, the catalyst retains high diesel yields (i.e. 84–94%) while selectively converting the heavy ends.

Figure 3:
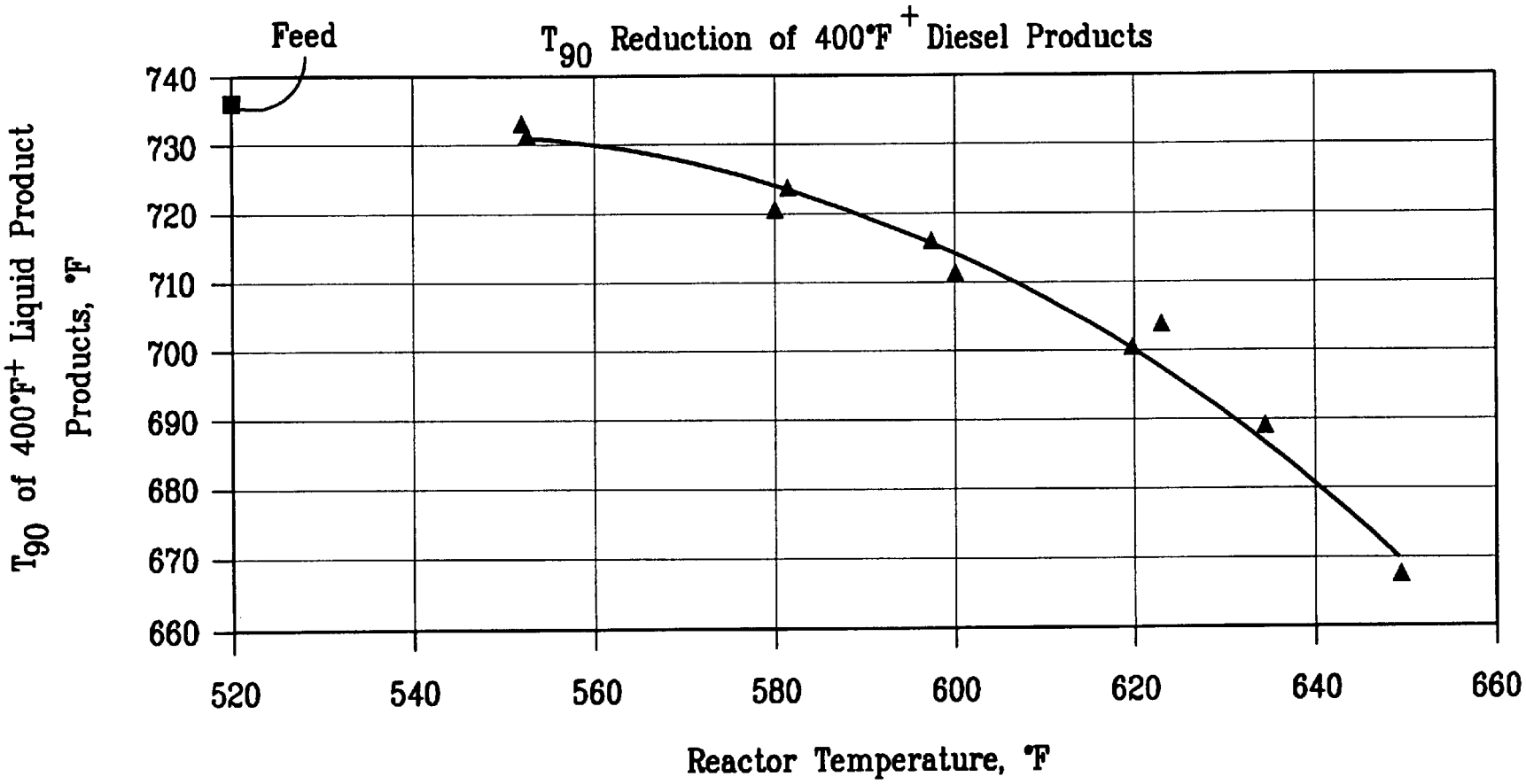
Figure 4:
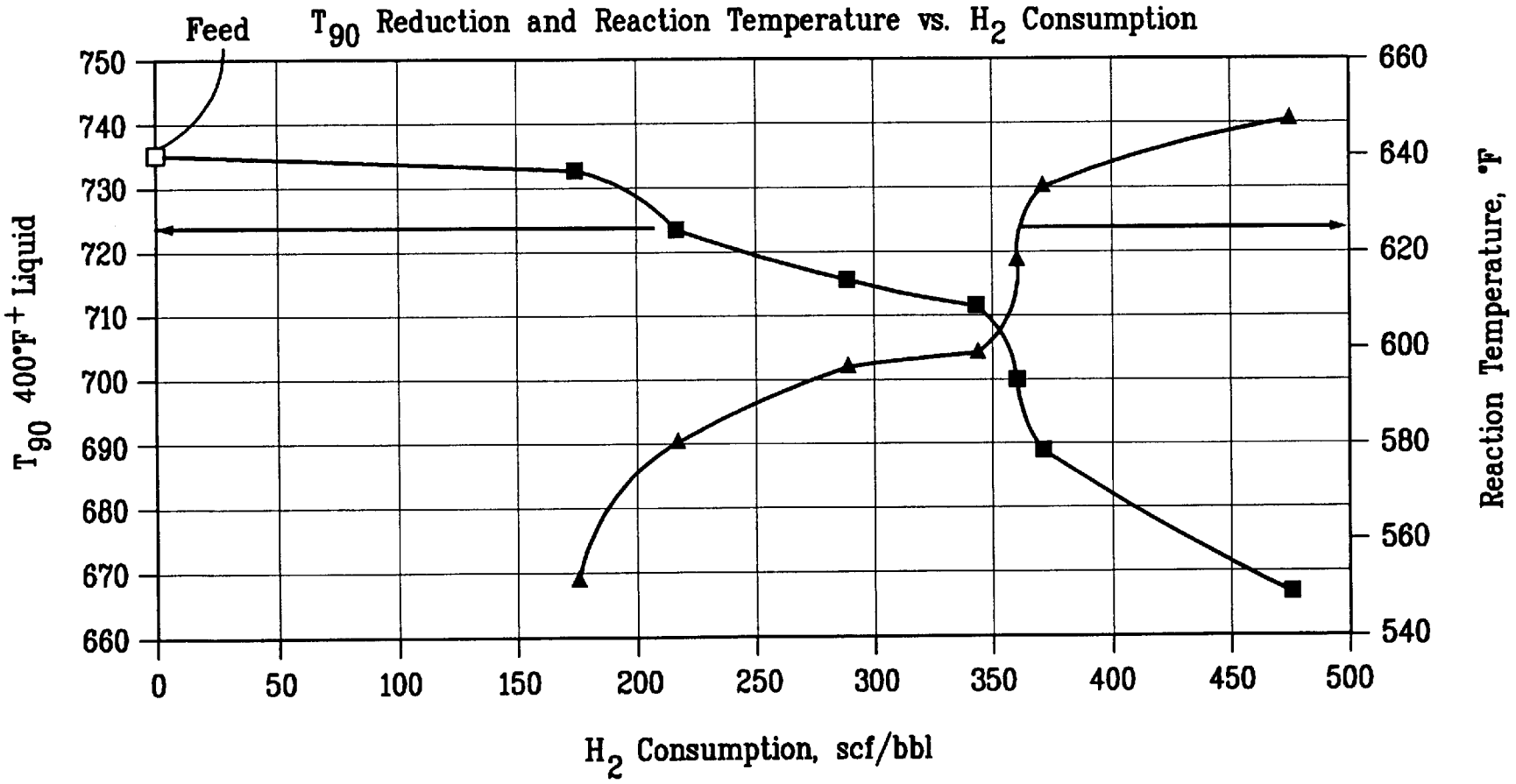

FIG. 3 shows $T_{90}$ of the converted 400° $F.^+$ liquid products. Reduction of $T_{90}$ from 736° F. observed with the feed to 719° F. by processing at 580° F. is mostly due to aromatic saturation. Treating at temperatures higher than 580° F. results in further $T_{90}$ reduction. This is attributed to back end hydrocracking, mild hydroisomerization, and finally, ring opening of naphthenic intermediates. This process reaction is further demonstrated in FIG. 4 which shows four distinct $H_2$ consumption rates and $T_{90}$ reduction domains at temperature ranges of 550–580, 580–600, 600–630, and 630° F.+. The results indicate the complicated nature of the catalytic hydrocracking reactions. FIG. 4 shows aromatic saturation occurring at 550–580° F. and back-end cracking occurring at 580–600° F. At 600–630° F., some mild hydroisomerization occurs on paraffins and naphthenic rings which result in further $T_{90}$ reduction, yet consume little hydrogen. In this range, due to higher temperature, low pressure, and also the lack of naphthenic ring opening activity, some aromatics start to reappear via dehydrogenation of naphthenic species. However, at temperatures exceeding 630° F., the competing naphthenic ring opening reaction commences rendering more hydrogen consumption, more $T_{90}$ reduction, and greater cetane enhancement.

EXAMPLE 3

Figure 5:
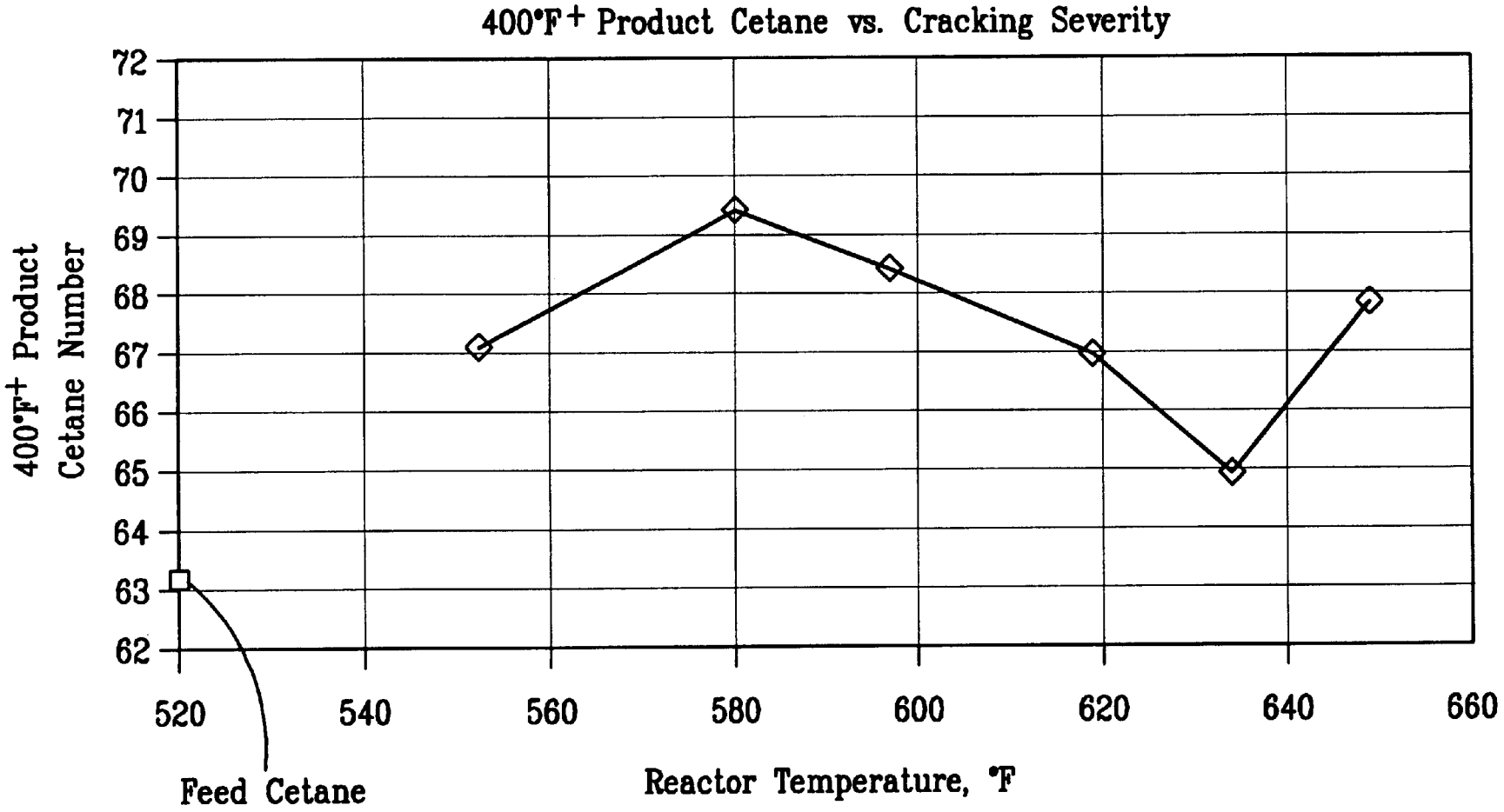

This example illustrates the increased cetane levels resulting from the process of the invention. FIG. 5 shows the cetane levels of the 400° $F.^+$ products with respect to reaction temperature. Table 4 gives a correlation of various 400° $F.^+$ and 650° $F.^+$ conversions with cetane of the 400° $F.^+$ products.

TABLE 4

Cetane Number vs. Front-End and Back-End Conversions

| | | Reaction Temperature | | | | | |
|---|---|---|---|---|---|---|---|
| | Feed | 550° F. | 580° F. | 597° F. | 619° F. | 634° F. | 649° F. |
| 400° F.+ Conversion (wt %) | | 3.8 | 8.6 | 13.2 | 17.2 | 25.9 | 31.8 |
| 650° F.+ Conversion (wt %) | | 8.0 | 25.8 | 28.0 | 44.1 | 55.5 | 69.5 |
| Cetane Number of 400° F.+ Products | 63.2 | 67.1 | 69.4 | 68.6 | 67.0 | 65.0 | 67.9 |

At reaction temperatures of 550–580° F., because of aromatic saturation, product cetane increases to 67–69, compared to 63 with the feed. At the higher temperatures between 580–630° F., because of a molecular weight reduction induced by back-end hydrocracking and also by a mild extent of hydroisomerization, cetane numbers gradually drop from 69–66. Finally, at 630° F.+, due to naphthenic ring opening, product cetane increases again to 68. Overall, product cetanes stay above the feed cetane of 63, while continuing end point reduction.

EXAMPLE 4

Figure 6:
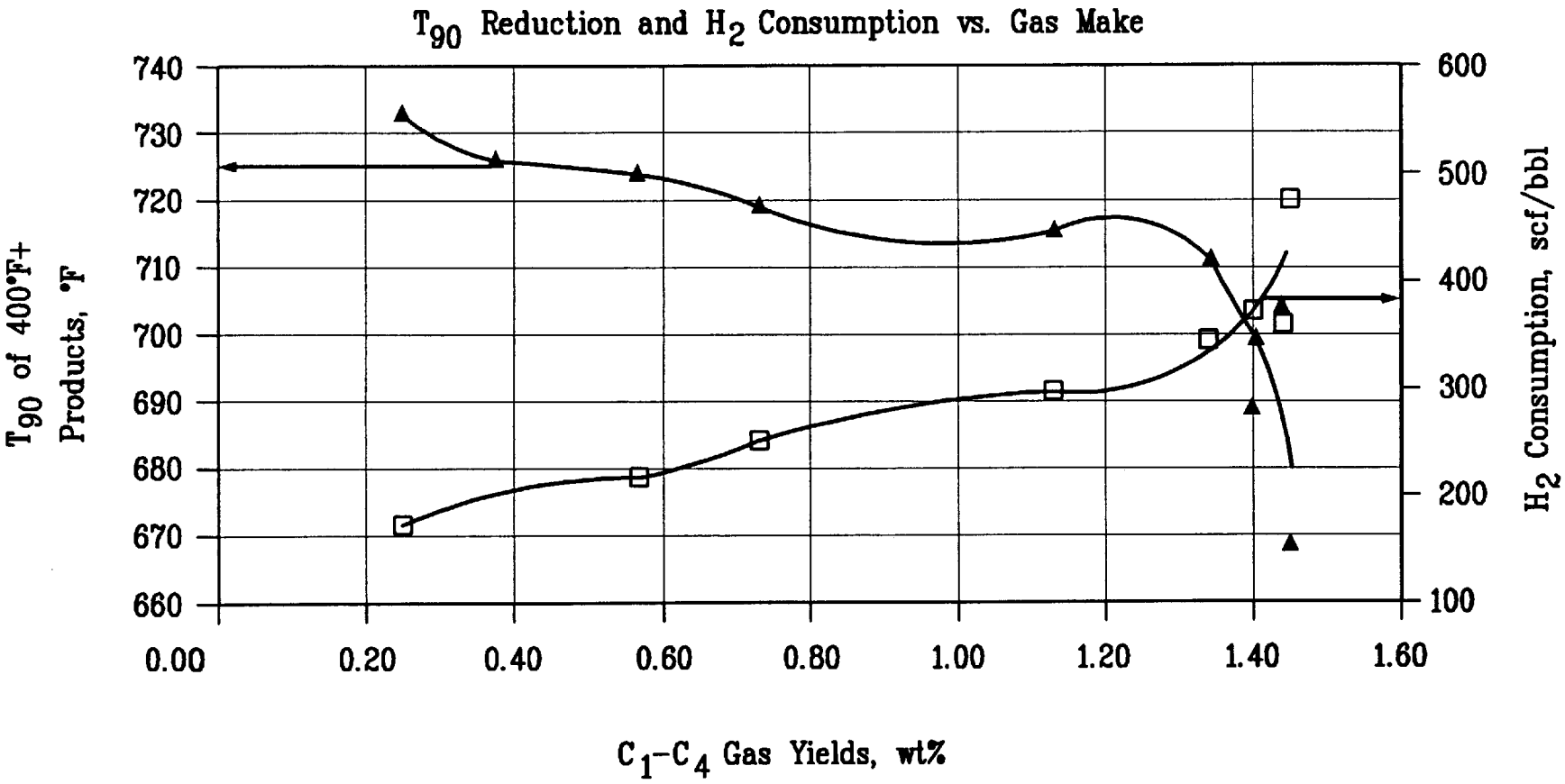

This example illustrates the low production of gases from the process of the invention throughout the range of reaction temperature as demonstrated in FIG. 6.

Up to 600° F., the reaction makes between 0.2 and 1.4 wt % of $C_1$–$C_4$. At temperatures greater than 600° F., the amount of gas made by the process appears to level off at ~1.4%. FIG. 6 shows that when $T_{90}$ of 400° F.+ products is reduced from 710 to 690° F. (i.e. at reactor temperatures of 600–630° F.), the gas yields level off at ~1.4 wt %, whereas $H_2$ consumption is greatly enhanced. This demonstrates the selective ring opening of naphthenes occurring at about 630° F., without making gaseous fragments. The reaction is distinctly different from that typically observed with other well known noble metal catalyzed hydrocracking catalysts where, due to a high temperature requirement (normally at >850° F.), methane is the predominant product.

EXAMPLE 5

A Pt/USY catalyst whose properties are listed in Table 2 was compared with a catalyst that has equivalent Pt content and dispersion, but does not contain the metal support properties required by the process. The catalyst used as a comparison is Pt/Alumina having an alpha acidity of less than 1. Both catalysts were contacted with a feedstock at a temperature of 680° F., 800 psig, WHSV 1.0, and $H_2$/Feed mole ratio of 6.0.

Table 5 contains the properties of both the feedstock and the product properties resulting from each of the catalysts. The example demonstrates the remarkable ring opening selectivity of Pt/USY, 96.6 wt % vs. the ring opening selectivity of Pt/Alumina, 0.0 wt %. Total ring opening conversion was 53.8 wt % for Pt/USY vs. 1.2 wt% for Pt/Alumina. These figures demonstrate how the process of the invention selectively opens the ringed structures to increase the paraffins necessary to produce a high cetane diesel fuel.

TABLE 5

Ring Opening Over Pt/USY and Pt/Alumina

| Catalyst<br>Product Dist., wt % | (Feed) | Pt/USY | (Feed) | Pt/Alumina |
|---|---|---|---|---|
| C4 Paraffins | | 0.2 | | 1.0 |
| C5–C9 Paraffins | | 2.1 | | 2.9 |
| C10–C13 Paraffins | | — | | 0.9 |
| C10 + -Alkylnaphthenes (C10–C11) | | 36.7 | | 0.0 |
| Decalin (+ trace tetralin) | 60.0 | 31.7 | 63.0 | 62.4 |
| 1-Methyldecalin | | 0.9 | | 9.3 |
| 1-Methylnaphthalene | 10.6 | 0.0 | 10.7 | 1.1 |
| I-Tetradecanes | | 12.7 | | 10.1 |
| n-Tetradecane | 29.4 | 15.7 | 27.1 | 12.4 |
| Total Ring Opening Conversion, wt % | | 53.8 | | 1.2 |
| Decalin Conversion, wt % | | 47.2 | | 1.0 |
| 1-Methylnaphthalene Conv., wt % | | 100.0 | | 89.7 |
| (1-MN + 1-M Decalin) Conv., wt % | | 91.2 | | 2.8 |
| n-Tetradecane Conversion, wt % | | 46.7 | | 54.2 |
| Ring Opening Selectivity, wt % | | 96.6 | | 0.0 |

Therefore, the process of the invention is capable of producing high cetane diesel fuels in high yield by a combination of selective heavy ends hydrocracking and naphthenic ring opening. More specifically, at 590–630° F., back-end cracking occurs with minimal hydroisomerization to form- multiply branched isoparaffins. When temperature exceeds 630° F., the catalyst becomes active in catalyzing selective ring opening of naphthenic species, boosting product cetane. Ring opening selectivity stems from stronger adsorption of naphthenes than paraffins over the catalyst. Using hydrocracker recycle splitter bottoms as a heavy endpoint distillate feed, the process maintained higher product cetane in all of the lower molecular weight diesels than that of the feed, while co-producing very little gas and retaining 95+% kerosene and diesel yields.

While there have been described what are presently believed to be the preferred embodiments of the invention, those skilled in the art will realize that changes and modifications may be made thereto without departing from the spirit of the invention, and it is intended to claim all such changes and modifications as fall within the true scope of the invention.

What is claimed is:

1. A process for selectively producing diesel fuels with increased cetane numbers from a hydrocarbon feed comprising contacting said feed under superatmospheric hydrogen conditions with a catalyst composition comprising a) a large pore crystalline molecular sieve material component having a faujasite structure and an alpha acidity of less than 1, and b) a group VIII noble metal component, wherein the feed contains at least 50 wt. % naphthenes and less than 40 wt. % aromatics, and wherein said feed is contacted with said catalyst at a pressure ranging from about 400 psi to about 1000 psi, a temperature ranging from about 550° F. to about 700° F. a space velocity ranging from about 0.1 LHSV to about 10 LHSV, and a hydrogen circulation rate of about 1300 SCF/bbl to about 5600 SCF/bbl.

2. The process as described in claim 1 wherein said crystalline molecular sieve material component is zeolite USY.

3. The process as described in claim 1 wherein said alpha acidity is about 0.3 or less.

4. The process as described in claim 1 wherein said Group VIII noble metal component is selected from the elemental group consisting of platinum, palladium, iridium, and rhodium, or a combination thereof.

5. The process as described in claim 4 wherein said Group VIII noble metal component is platinum.

6. The process as described in claim 1 wherein said Group VIII noble metal component has a particle size of less than about 10 Å.

7. The process as described in claim 1 wherein the content of said Group VIII noble metal component is between about 0.01 and about 5 wt % of said catalyst.

8. The process as described in claim 5 wherein the platinum is dispersed on said crystalline molecular sieve component, said dispersion being characterized by an H/Pt ratio of between about 1.1 and 1.5.

9. The process as described in claim 1 wherein said catalyst is formed by self and/or silica binding.

* * * * *